US005161337A

United States Patent [19]

Swain

[11] Patent Number: 5,161,337

[45] Date of Patent: Nov. 10, 1992

[54] MOBILE SURFACE ABRADING APPARATUS

[76] Inventor: Jon M. Swain, 3145 Holloway Rd., Ruston, La. 71270

[21] Appl. No.: 649,737

[22] Filed: Feb. 1, 1991

[51] Int. Cl.[5] ..... B24C 3/06

[52] U.S. Cl. ..... 51/429; 51/425

[58] Field of Search ..... 51/429, 424, 425; 209/290, 291, 296

[56] References Cited

U.S. PATENT DOCUMENTS

| | | | |
|---|---|---|---|
| 1,554,976 | 9/1925 | Kearns | 209/291 |
| 3,392,491 | 7/1968 | Vogt | 51/424 |
| 3,934,372 | 1/1976 | Diehn | 51/425 |
| 3,981,104 | 9/1976 | Dreher | 51/429 |
| 4,771,579 | 9/1988 | Giese | 51/425 |
| 4,841,681 | 6/1989 | Dickson | 51/429 |

FOREIGN PATENT DOCUMENTS

| | | | |
|---|---|---|---|
| 1518785 | 7/1978 | United Kingdom | 51/424 |
| 2203072 | 10/1988 | United Kingdom | 51/429 |

*Primary Examiner*—Robert A. Rose
*Attorney, Agent, or Firm*—John M. Harrison

[57] ABSTRACT

A mobile surface abrading apparatus for cleaning and texturing the surface of horizontal, or near horizontal, structures, particularly roads, highways, airport runways and the like. Abrasive particles such as steel shot or grit are projected at the structure surface in angular relationship to abrade and etch the surface and the abrasive rebounds into one or more vertical abrasive conveyors, where it is transferred by air to a rotating screen, separated from the air, road debris and dust and recycled and repeatedly projected onto the surface to be treated. Air flow upwardly through the vertical abrasive conveyors is carefully controlled to lift the abrasive particles, as well as the dust and debris, beyond the rebound energy boundary and effect efficient recycling of the particles.

18 Claims, 6 Drawing Sheets

MOBILE SURFACE ABRADING APPARATUS

BACKGROUND OF THE INVENTION

1. Field of the Invention

This invention relates to apparatus for treating horizontal structure surfaces, and more particularly, to a mobile surface abrading apparatus which utilizes air circulation to recycle rebounding abrasive from the surface through a separation system and into a hopper, where it is fed to an abrasive propulsion device, or devices, and where the abrasive media or particles are projected at the surface at high velocity in angular relationship and the rebounding abrasive particles and surface materials such as dust and debris, are recovered from the surface by air flow through one or more vertical abrasive conveyors. The mobile surface abrading apparatus is capable of operating with one or more mechanical conveyance devices providing energy to the abrasive particles for transporting the abrasive particles and surface debris to the separation system.

This invention is characterized by a continuous air flow system and an improvement in the lifting of abrasive and debris in a vertical or near-vertical direction with air movement alone, allowing two or more propulsion devices to treat the area adjacent to the air flow conveyor. The principle involves a selected air flow which is forced through restricted passages where particulate transfer is effected and non-restricted areas where separation of air and abrasive particles is accomplished. The abrading apparatus includes passages that allow abrasive and other particulate to be received from one or more angles, which facilitates an internal area of sufficient size to sustain an appropriate air velocity which forces the various particles to be encountered, both transversely in the sweeping function and upwardly in the conveying function, against the pull of gravity.

In the vertical conveying function, the maximum speed at which any object will fall is reached when atmospheric friction equals gravitational pull and this speed is known as the terminal velocity. The air flow system of this invention is designed to slightly exceed this terminal velocity and thus convey the abrasive particles upwardly through the apparatus. The pneumatic conveyance of abrasive particles in the apparatus of this invention would not normally require dust-handing equipment. Nonethless, the abrading operation is very dusty unless a dust collector is used and dust collection is mandated by environmental laws and common sense. Accordingly, a blower must be used to exhaust the cleaned air from the dust collector. This invention combines a dual purpose pressure blower that is properly sized for the volume and intensity necessary to satisfy the needs of the dust filters and the vertical abrasive and debris conveying chamber to recycle the spent abrasive particles.

Sweeping of the horizontal structure surface to be treated is accomplished by allowing air that usually leaks around surface seals to enter the blast area, normally from the trailing wall of the apparatus, in such a way that the abrasive particles do not escape. There is a constant spatter of abrasive particles at the point where the blast stream of abrasive particles strikes and deflects from the structure surface. An abrasive particle collision on or about the surface level at a sharp angle can cause the abrasive particles to project forcefully and abruptly in different directions. If an opening is located in the apparatus where abrasive particles can project, by deflection or directly, to the outside, these misdirected abrasive particles will escape at high speed, causing damage to machinery and constituting a danger to personnel in the immediate area. The apparatus of this invention facilitates entry of air at the trailing wall of the blast head, after being forced at high speed across a given structure surface area, without the danger presented by escaping particulate. Upon entry into the apparatus, air velocity sweeps through the machine and a small percentage of abrasive particles becomes wedged in the crevices where the blast head contacts the treated surface.

The improvement of this invention includes carefully forming a corridor in which the lower containment structure constitutes the treated structure surface area behind the blasting area and an upper wall that is adjustable in order to vary the internal air intake area, and therefore the velocity, of the upwardly deflected abrasive particles at a selected air flow. A pair of spaced floating and deflector seals contact and seal at the structure surface. A third side or wall is supplied with fixed resilient seal and a fourth, or trailing wall is open to the atmosphere for the intake of air. This corridor defines a passageway in which air is forced, either longitudinally or transversely, but in either case horizontally, across the structure surface immediately behind the blast travel area, in order to entrain loose abrasive and debris particles. This horizontal air flow has adequate force at structure surface level to entrain any loose particles lying there and convey the abrasive and debris particles through a labyrinth-type passageway. This passageway is constructed in such a way as t make it virtually impossible for any of the particles to escape the blast area under the force of retained kinetic energy.

DESCRIPTION OF THE PRIOR ART

In existing surface treating machines utilizing an abrasive propulsion device, the abrasive is hurled toward the surface to be treated and after striking the structure surface, the abrasive deflects at an angle. In smaller machinery, the rebounding kinetic energy is usually sufficient to transfer the abrasive particles to a point above the abrasive propulsion device, therefore completing a cleaning cycle with no further (or very little) input of energy necessary to recycle the abrasive particles.

A problem exists when this technique is operated on soft or irregular surfaces where most of the kinetic energy in such an operation is absorbed or misdirected, since there is insufficient abrasive rebound to complete the recovery and redirection cycle. Another problem exists when the machine is sufficiently large to require that the rebounding abrasive particles reach a higher level than would normally be necessary in smaller machines. There is only a finite quantity of kinetic energy storage is possible in an abrasive particle and this energy varies according to the size of the abrasive particle and the angle at which it strikes the structure surface. The larger the particle, and the less the angle at which it strikes the structure surface, the higher the level of kinetic energy retained.

When an abrasive is used that is sufficiently small to provide good cleaning area coverage and when this abrasive is propelled toward the horizontal structure surface at any angle that would facilitate a productive amount of work, there is usually not an adequate amount of energy left in the abrasive particles to reach a very high level in the recovery mechanism. In the past, machines which needed a higher elevation of spent abrasive particles relied on magnets, rotary brooms, bucket elevators and the like, to lift particles beyond the rebound energy boundary.

There are various devices known in the art for abrading road and other horizontal structure surfaces for the purposes of texturing and cleaning the surfaces. In each case, the accepted technique includes forcing the abrasive particles at the structure surface to be textured or cleaned in angular relationship and utilizing various techniques, including abrasive rebound energy, to recycle the particles back to the abrasive propulsion device or devices. In addition to the rebounding energy mechanism, other techniques such as magnets, rotary brooms, mechanical conveyors and elevators, as well as induced air currents with entry points at or above structure surface levels, have been used with varying degrees of success, to recover and recycle the abrasive particles. One problem which has become apparent regarding machines which depends mostly on rebound for abrasive recycling is the los kinetic energy of the abrasive particles after they strike the structure surface to be abraded. This energy loss causes the particles to drop back onto the structure surface, where they accumulate and are lost from the recycle process. If this condition becomes sufficiently pronounced to form a multiple layer of abrasive on the surface to be abraded, additional abrasive propelled onto this accumulated layer will lose virtually all kinetic energy upon contact with the layer due to absorption, thereby compounding the rebounding problem. Under these conditions, total evacuation of the abrasive supply hopper in the machine soon occurs and the accumulation of abrasive particles must then be recovered from the structure surface, usually by manual labor, using brooms, shovels and buckets to reload the hopper, thus necessitating costly machine downtime.

In my U.S. Pat. No. 4,433,511, dated Feb. 28, 1984, entitled "Mobile Abrasive Blasting Surface Treating Apparatus", I detail a mobile apparatus for treating structure surfaces by abrasive blasting. The apparatus includes a mobile housing with self-propelled, endless tracks for traversing the surface to be treated. The housing includes a reservoir for containing abrasive particles and a rotary wheel with blades that rotate to propel the abrasive particles against the surface to be treated in angular relationship and abrade or etch the surface. A return passage for the particles has an opening at the angle of rebound of the particles extending toward the reservoir and multiple trays receive the recirculating particles and fill with particulate material, which material then spills into the reservoir. Particulate material on the trays absorbs the kinetic energy from the following or trailing particles to prevent further rebounding. The particles spill from the trays in a stream or sheet intersected by a stream of air and trays separate the more coarse particulate debris from the abrasive particles en route back to the reservoir. Dust collectors are provided to separate the dust from the air used in separating coarse debris from the abrasive particles and from the air flow, to assist in sweeping debris from beneath the apparatus.

Typical of the abrading devices known in the prior art are those detailed in the following U.S. Patents: U.S. Pat. No. 1,954,111, dated Apr. 10, 1934, to J. Wilkes, entitled "Machine for Abrading Concrete Surfaces"; U.S. Pat. No. 3,858,359, dated Jan. 7, 1975, to Raymond M. Leiliart, entitled "Mobile Surface Treating Apparatus"; U.S. Pat. No. 3,877,174, dated Apr. 15, 1975, to Clyde A. Snyder, entitled "Mobile Surface Treating Apparatus"; U.S. Pat. No. 3,906,673, dated Sep. 23, 1975, to T. Goto, et al, entitled "abrasive Cleaning Machine"; U.S. Pat. No. 3,934,373, dated Jan. 27, 1976, to Raymond M. Leiliart, entitled "Portable Surface Treating Apparatus"; U.S. Pat. No. 3,977,128, dated Aug. 31, 1976, to James R. Goff, entitled "Surface Treating Apparatus"; U.S. Pat. No. 4,080,760, dated Mar. 28, 1978, to Raymond Leiliart, entitled "Surface Treatment Device Including Magnetic Shot Separator"; U.S. Pat. No. 4,052,820, dated Oct. 11, 1977, to John C. Bergh, entitled "Portable Surface Treating Apparatus"; U.S. Pat. No. 4,336,671, dated Jun. 29, 1982, to Robert T. Nelson, entitled "Surface Cleaning Apparatus"; U.S. 4,364,823, dated Dec. 21, 1982, entitled "Apparatus for Separating Abrasive Blasting Media from Debris"; U.S. Pat. No. 4,376,358, dated Mar. 15, 1983, to John J. Shelton, entitled "Surface Treating Apparatus"; U.S. Pat. No. 4,377,922, dated Mar. 29, 1983, to John C. Bergh, entitled "Portable Apparatus for Treating Surfaces"; U.S. Pat. No. 4,377,923, dated Mar. 29, 1983, to John C. Burgh, entitled "Surface Treating Apparatus"; U.S. Pat. No. 4,377,924, dated Mar. 29, 1983, to John C. Bergh, entitled "Portable Device for Treating Surfaces"; U.S. Pat. No. 4,382,352, dated May 10, 1983, to Robert T. Nelson, entitled "Apparatus for Cleaning Surfaces, Including Means for Separating Debris and Abrasive Material"; U.S. Pat. No. 4,394,256, dated Jul. 19, 1983, to James R. Goff, entitled "Apparatus for Separating Abrasive Blasting Media from Debris"; U.S. Pat. No. 4,406,092, dated Sep. 27, 1983, entitled "Surface Cleaning Machine"; U.S. Pat. No. 4,416,092, dated Nov. 22, 1983, entitled "Cleaning Apparatus"; U.S. Pat. No. 4,646,481, dated Mar. 3, 1987, to Wayne E. Dickson, entitled "Surface Blasting Apparatus"; and U.S. Pat. No. 4,693,041, dated Sep. 15, 1987, to Wayne E. Dickson, entitled "Surface Blasting Appartus".

BRIEF DESCRIPTION OF THE DRAWINGS

This invention will be better understood by reference to the accompanying drawings, wherein.

DESCRIPTION OF THE PREFERRED EMBODIMENTS

Figure 1:
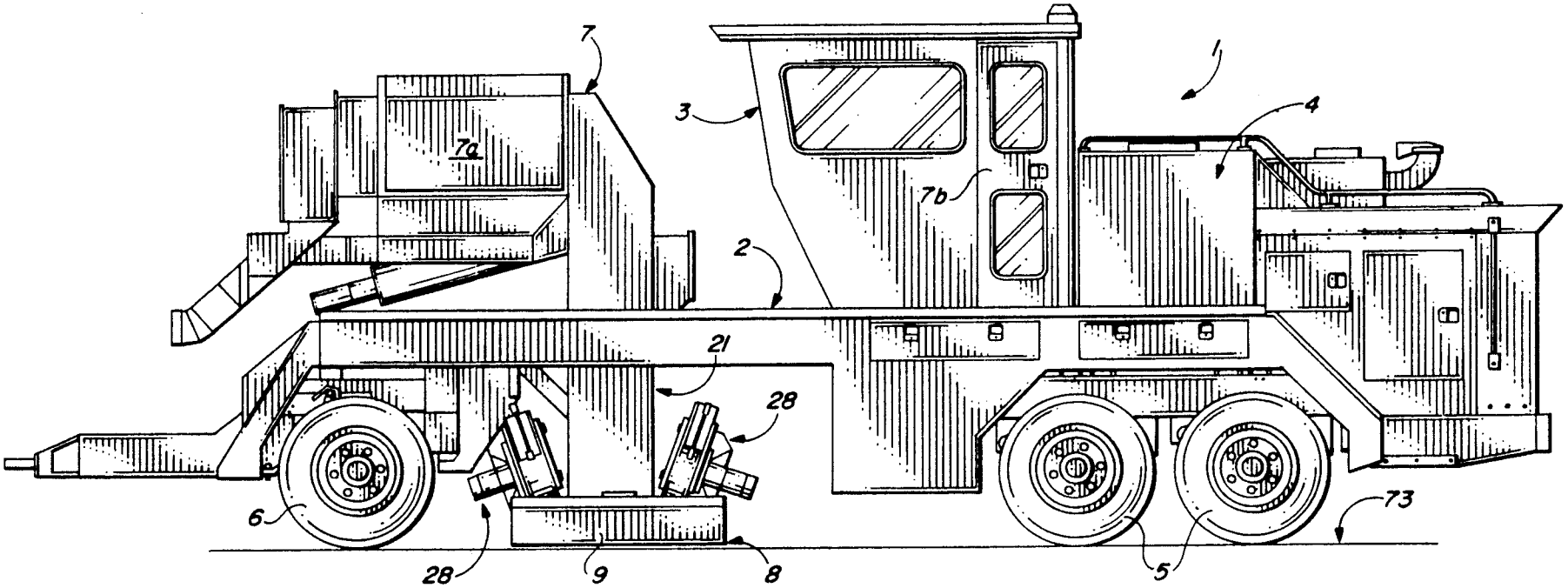
FIG. 1 is a side view of a preferred embodiment of the mobile road surface texturing apparatus of this invention.

Referring initially to FIG. 1 of the drawings, the mobile road surface texturing apparatus of this invention is generally illustrated by reference numeral 1. The mobile road surface texturing apparatus 1 is characterized by a frame 2, fitted with a cab 3, provided with cab doors *7b*, an engine compartment 4, rear wheels 5 and front wheels 6 for traversing a horizontal structure surface 73, such as a road, highway or airport runway. A pair of blast heads 21 (one of which is illustrated) project downwardly from the frame 2 forwardly of the cab 3 and rearwardly of the front wheel 6 and each include two pairs of oppositely-disposed abrasive propulsion devices 28 (one pair of which is illustrated), mounted between a pair of parallel sweeper side plates 9, in each blast head 21. Each blast head 21 is also coupled to an abrasive separation system 7, projecting above the frame 2 forward of the cab 3, as illustrated.

Figure 2:
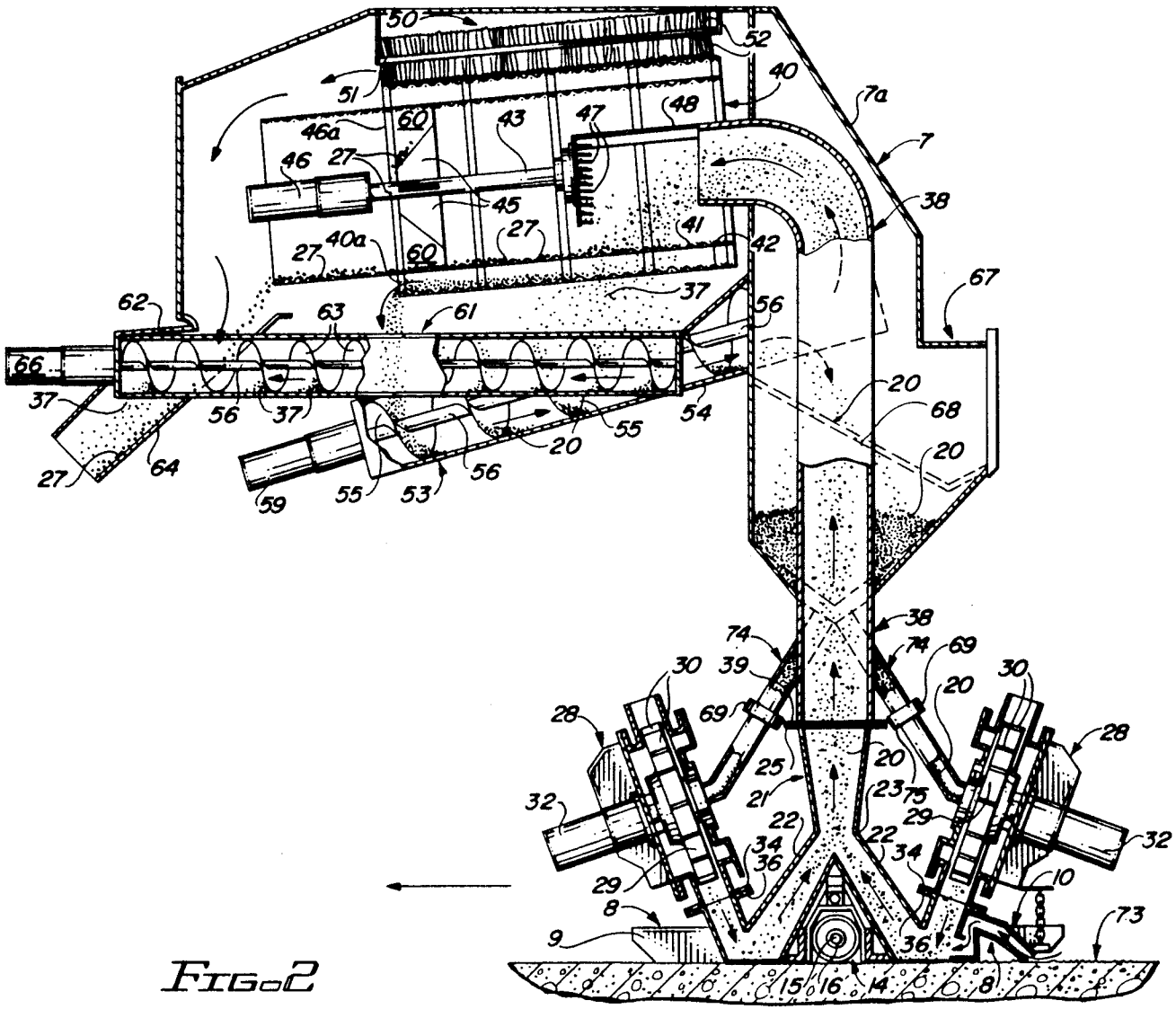
FIG. 2 is an enlarged side sectional view of the abrasive handling system of the mobile road surface texturing apparatus illustrated in FIG. 1.
Figure 3:
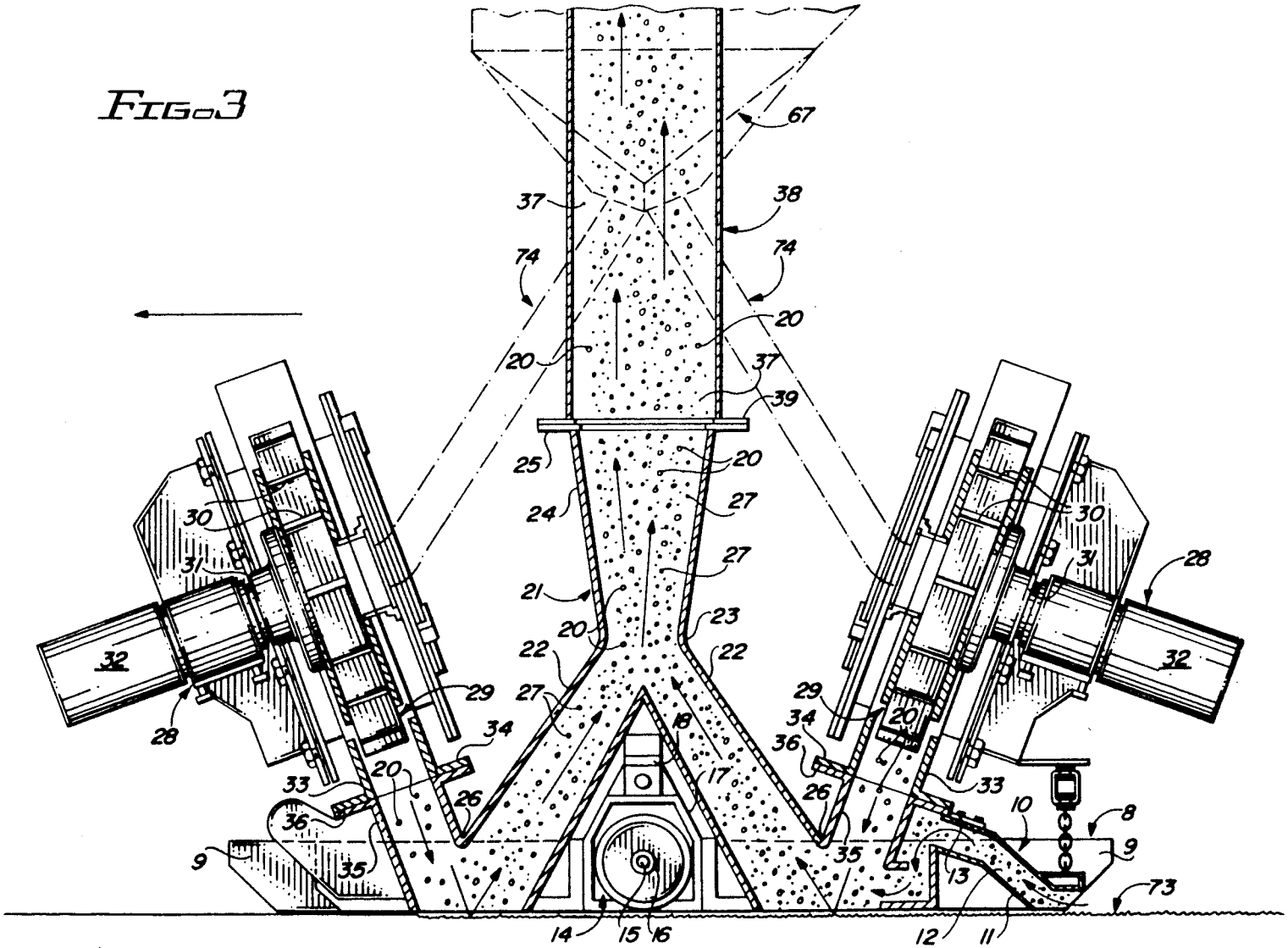
FIG. 3 is an enlarged side sectional view of the lower portion of the abrasive handling system illustrated in FIG. 2.

Referring now to FIGS. 1–4 of the drawings, the blast heads 21 are fitted with an air sweeper assembly 8, bounded by the parallel, spaced sweeper side plates 9, provided in the blast heads 21 and provided with an air-receiving sweeper channel 10, defined by a resilient leg 11 and a channel plate 13, which receives the resilient leg 11, as illustrated in FIG 3. A leg plate 12 joins the resilient leg 11 to the channel plate 13, such that one end of the resilient leg 11 is located adjacent to the horizontal structure surface 73 which is subjected to texturing and abrading by the mobile road surface texturing apparatus 1. A roller 14 is journalled for rotation in the blast heads 21 by means of roller shaft bolts 15, cooperating roller bearings 16 and bearing supports 17, as further illustrated in FIG. 3. A resilient shock absorber 18 is located at the top of the bearing support 17 to absorb the shock when the air sweeper assembly 8 and blast heads 21 traverse the horizontal structure surface 73 by operation of the roller 14. Each blast head 21 further includes a pair of rebound legs 22, each of which extends downwardly in angular relationship in inverted Y-fashion from a corresponding rebound beck 23 to a mirror angle 26, as further illustrated in FIG. 2. Each rebound leg 22 then extends upwardly at approximately the mirror angle 26 to define the discharge extension 35, having a discharge extension flange 36 which mounts on the wheel discharge flange 34 of the wheel discharge 33 of corresponding abrasive propulsion devices 28, which are oriented in angular relationship with respect to the horizontal structure surface 73. Each of the four abrasive propulsion devices 28 is fitted with a rotating wheel 29, having wheel blades 30, a wheel hub 31 and a hydraulic wheel motor 32, connected to the wheel hub 31, for driving the rotating wheel 29 at a preselected rotational speed. The wheel discharge 33 is provided with a wheel discharge flange 34, which matches the corresponding discharge extension flange 36 located in each discharge extension 35. Accordingly, when the rotating wheels 29 are operating, abrasive 20, such as steel shot, is fed through the feed conduits 74 (illustrated in FIG. 2 and in phantom in FIG. 3), into the center of the rotating wheels 29 and is discharged at high velocity at each wheel discharge 33 through the respective discharge extension 35, onto the horizontal structure surface 73. The abrasive 20 rebounds from the horizontal surface 73 into the respective rebound legs 22, respectively, at the approximate mirror angle 26, as hereinafter further described. A collection leg 24 (one of which is illustrated) extends upwardly from the rebound neck 23 element of each blast head 21 and terminates at a collection leg flange 25, which is connected to a cooperating tube flange 39, terminating the bottom end of a corresponding upward-standing vertical abrasive conveyor 38. The abrasive 20 is mixed with gravel 27 and dust 37, as well as other debris, such as road chips and the like, in the upwardly-directed air stream, as illustrated in FIGS. 2 and 3 and these materials must be separated in order to recycle and reuse the abrasive 20, as further hereinafter described.

Referring now to FIGS. 1, 2, 4 and 5 of the drawings, the abrasive separation system 7 is designed to receive the abrasive 20, gravel 27 and dust 37 which are channeled through the twin vertical abrasive conveyors 38. This material enters a pair of parallel, slightly downwardly-tilting rotating screen drums 40 (one of which is illustrated), each of which includes a fine screen 42, extending around the periphery of the screen drum 40 and a course screen 41, located inside the fine screen 42 in spaced relationship, to define an annular cylindrical space. The discharge ends of the twin vertical abrasive conveyors 38 are sealed in the inlet ends of the respective screen drums 40, to prevent loss of abrasive 20, gravel 27 and dust 37. A pair of screen brooms 50 are mounted in the screen cabinets *7a*, illustrated in FIG. 5 and enclosing the screen drums 40, respectively, and each include a broom shaft 51, fitted with multiple broom bristles 52, which contact and continually clean the fine screens 52. The abrasive 20, gravel 27, and dust 37 enter the screen drums 40 at one end and strike multiple arresting shelves 47, which are aligned in vertically-spaced relationship and are attached to a shelf bracket 49, provided on the extending end of a screen shaft 43, as the air diffuses from the rotating screen drums 40. A shelf plate 48 projects from the top one of the arresting shelves 47 to the mouth of each vertical abrasive conveyor 38, in order to prevent the abrasive 20, gravel 27 and dust 37 from flowing upwardly in the screen drums 40 with the air stream. The opposite end of each screen shaft 43 is secured to a screen shaft motor 46 and the air deflector 44 allows air to flow upwardly from the mouth of each vertical abrasive conveyor 38, conveyor 38, through the coarse screens 41 and the fine screens 42, respectively, while the abrasive 20, gravel 27 and dust 37 fall downwardly by operation of gravity to the coarse screens 41 and the fine screens 42, respectively, as illustrated in FIG. 3. Blades 60 are built into the lower forward end of the screen drums 40 and extend outwardly from a corresponding cone 45, mounted on the screen shaft 43. The blades 60 are designed to engage and transport trapped gravel 27 which collect at the ends of the screen drums 40 on the coarse screen 41 as the screen drums 40 rotate. The gravel 27 migrate forward to the ends of the screen drums 40 due to the rotation of the downwardly-tilted screen drums 40, for engagement by the respective blades 60. The gravel 27 are, in turn, rotated by the blades 60, discharged from additional openings (not illustrated) located in the forward end of the screen drums 40 and collected in a pair of dust conveyor discharges 64, along with the dust 37, which filters donwardly through both the coarse screens 41 and the fine screens 42 and deposits in the twin dust conveyors 61. The dust conveyors 61 are each located beneath a separate one of the screen drums 40 and above the twin dust conveyor discharges 64, and are characterized by an open-top, cylindrical dust conveyor housing 62, having a dust conveyor feed opening 65, and receives a rotating dust conveyor screw 63, driven by a dust conveyor motor 66, to move the accumulated dust 37 into the dust conveyor discharges 64, where it is mixed with the gravel 27, as further illustrated in FIG. 3. A vacuum system (not illustrated) is connected to the dust conveyor discharges 64 to cause the flow of air into the sweeper channel 10, through the blast heads 21 and upwardly through the vertical abrasive conveyors 38, as described above.

Figure 4:
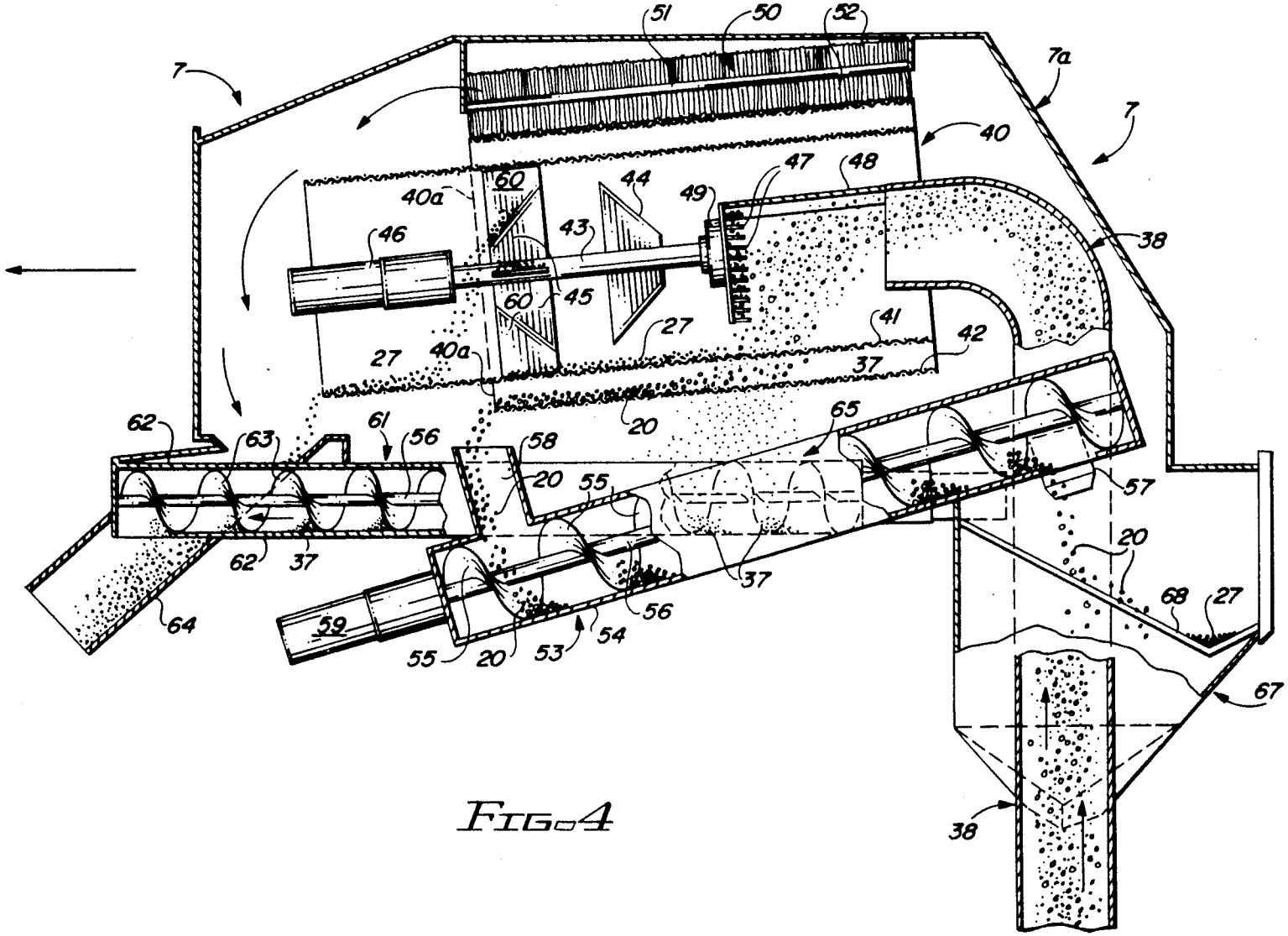
FIG. 4 is an enlarged side sectional view of the upper portion of the abrasive handling system illlustrated in FIG. 2.
Figure 5:
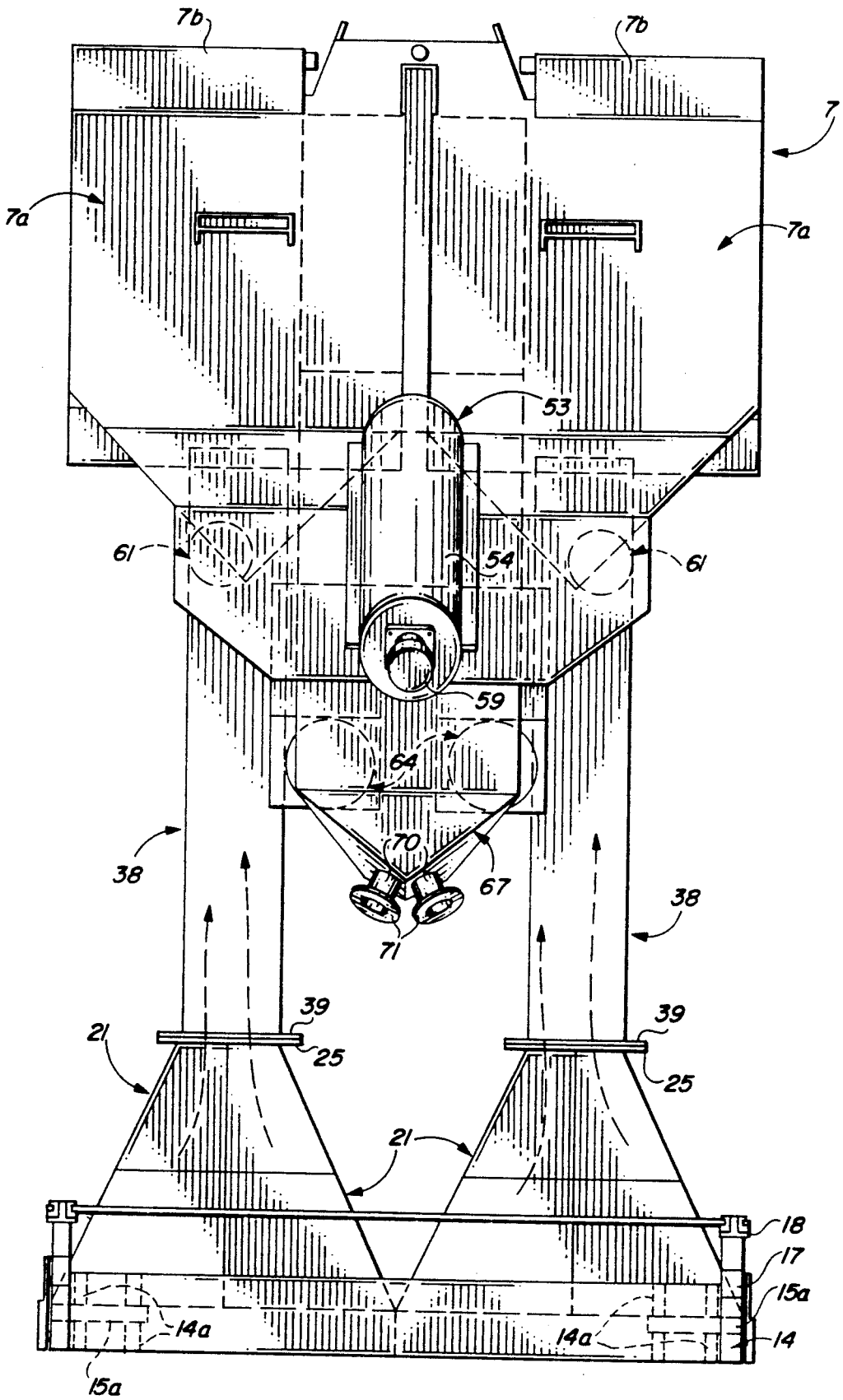
FIG. 5 is a front view of the blast head and vertical abrasive conveyor components of the mobile road surface texturing apparatus illustrated in FIGS. 1–4.

The abrasive 20 is typically characterized by steel shot which is sufficiently small to traverse the mesh of the coarse screens 41, but too large to pass through the mesh of the fine screens 42. Accordingly, the abrasive 20 is trapped in the annulus between the coarse screens 41 and the fine screens 42 in the screen drums 40, respectively, and migrates by rotation of the screen drums 40 through an opening (not illustrated) at the outer periphery of each forward drum plate 40*a*, into an abrasive conveyor feed 58, as illustrated in FIG. 4. From the abrasive conveyor feed 58, the abrasive 20 drops into one end of a downwardly-tilted abrasive conveyor 53, which is characterized by a cylindrical abrasive conveyor housing 54 and an abrasive conveyor screw 55, mounted on a screw shaft 56, driven by the abrasive conveyor motor 59 and enclosed by the abrasive conveyor housing 54. In a most preferred embodiment of the invention the abrasive conveyor 53 is canted forwardly and downwardly with respect to the screen cabinet 7*a*, illustrated in FIG 4, and the abrasive 20 is slowly forced upwardly and rearwardly along the incline by operation of the abrasive conveyor screw 55 to the abrasive conveyor discharge 57, where the abrasive 20 drops by operation of gravity into the mouth of the hopper 67. A hopper plate 68 is located in the hopper 67 to trap any additional gravel 27 which may have been sufficiently small to pass through the coarse screen 41, but larger than the mesh in the fine screens 42. The abrasive 20 then drops through properly sized openings in the hopper plate 68 directly into the hopper 67, where it is held for sequential distribution to the respective oppositely-disposed pairs of abrasive propulsion devices 28, through the corresponding feed conduits 74, as illustrated in FIG. 2.

Referring again to FIGS. 2 and 5 of the drawings, in a most preferred embodiment of the invention a pair of feed tube nipples 70 are welded or otherwise attached to the bottom of the hopper 67, as illustrated in FIG. 5, in order to locate and secure the feed conduits 74 between the respective abrasive propulsion devices 28 and the hopper 67. Accordingly, the abrasive 20 is allowed to flow freely in a steady stream from the hopper 67 to metering valves 69, through each of the feed conduits 74 into the respective abrasive propulsion devices 28, to facilitate a continuous, high velocity spatter of abrasive 20 against the horizontal structure surface 73 at a contact and rebound area and recycyling in sequence through the blast heads 21, the vertical abrasive conveyors 38 and the abrasive separation system 7, back into the hopper 67.

Figure 6:
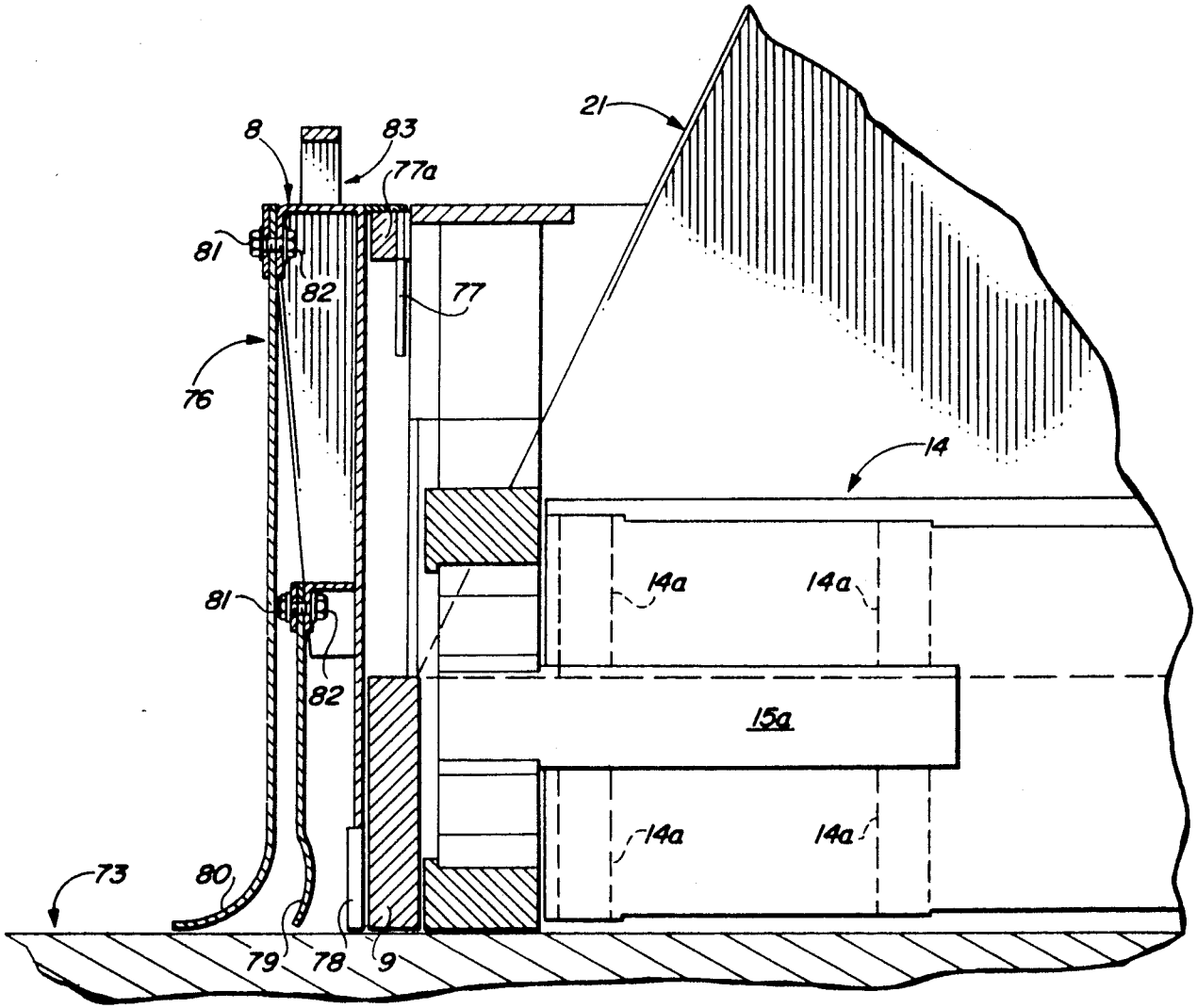
FIG. 6 is an enlarged front view of the lower segment of the blast head element of the abrasive handling system, more particularly illustrating preferred sealing components.

As illustrated in FIG. 6 of the drawings, the blast heads 21 are sealed against the horizontal structure surface 73 by a pair of spaced floating deflector and seals 76, which "float" with respect to the blast heads 21 by means of a stay plate 77, removably mounted on a plate mount 77*a*. A separate seal plate 78, resilient seal 79 and flexible seal flap 80 effect this seal, wherein the flexible seal flap 80 and resilient seal 79 are attached to the seal plate 78 by means of bolts 81 and nuts 82, respectively. A handle 83 is provided on each of the seal plates 78 for handling the respective floating deflector and seals 76.

Referring again to the drawings, the mobile road surface texturing apparatus 1 operates as follows. Referring initially to FIGS. 1-3, air is caused to circulate from the atmosphere through the sweeper channel 10 located in the air sweeper assembly 8 in the direction of the arrows, as illustrated in FIG. 2, by operating a vacuum system (not illustrated) connected to the dust conveyor discharges 64. This air is channeled from the sweeper channel 10 upwardly through the rebound legs 22 of the respective blast heads 21 which are closest to the sweeper channel 10, and through the corresponding twin vertical abrasive conveyors 38, into the parallel screen drums 40 and from the screen drums 40 through the twin dust conveyor discharges 64. Abrasive 20 which rebounds from the horizontal structure surface 73 into the oppositely-disposed rebound legs 22 located farthest from the sweeper channel 10 joins the abrasive 20, gravel 27 and dust 37 from the other rebound legs 22 at the rebound neck 23 and the combined composite of abrasive 20, gravel 27 and dust 37 is swept by the air stream into the twin vertical abrasive conveyors 38, as hereinafter further described. The abrasive 20, which may be steel shot or the like, is fed from the hopper 67, through metering valves 69 and through each of the feed conduits 74 to the centers of the respective rotating wheels 29 of the oppositely-disposed sets of abrasive propulsion devices 28, where the abrasive 20 is forced from each wheel discharge 33 of the rotating wheels 29 at high velocity against the horizontal structure surface 73, as further illustrated by the arrows in FIG. 2. Since the abrasive 20 is directed against the horizontal structure surface 73 at an angle which corresponds approximately to the mirror angle 26, the abrasive 20 rebounds into the respective rebound legs 22 and the rebound energy of the abrasive 20 allows the abrasive 20 to reach or approach the rebound neck 23. At this point, the air sweeping across the horizontal structure surface 73 in the blast heads 21 and circulating upwardly through the rebound legs 22 and into the vertical abrasive conveyors 38, counteracts the pull of gravity on the abrasive 20, as well as the dust 37 and gravel 27 mixed with the abrasive 20, and causes the mixture to move upwardly through the vertical abrasive conveyors 38 into the screen drums 40. Movement of the mobile road surface texturing apparatus 1 in the direction of the arrow illustrated in the drawings effects a continuous sweeping of the horizontal structure surface 73 and the air stream picks up any loose abrasive 20 which does not rebound with sufficient energy into the respective rebound legs 22. After reaching the screen drums 40, the air diffuses from the screen drums 40, and the mixture then contacts the arresting shelves 47 and the respective coarse screens 41, which coarse screens 41 separate the larger gravel 27 from the abrasive 20, dust 37 and smaller gravel 27. The abrasive 20 is collected on the respective fine screens 42 and is channeled from the screen drums 40 into the abrasive conveyor feed 58 and ultimately, into the abrasive conveyor 53 and back into the hopper 67, where it is again channeled to the abrasive propulsion devices 28 to complete the abrading cycle, as heretofore described. The gravel 27 and dust 37 are collected by means of the coarse screens 41 and a dust conveyor 61, respectively, into the dust conveyor discharge 64, for transfer to a truck or other collection vehicle, for later disposal.

It will be appreciated by those skilled in the art that an important preferred characteristic of the mobile road surface texturing apparatus 1 of this invention is the provision of a pair of vertical abrasive conveyors 38 which receive a constant flow of air from the twin blast heads 21, which air flow is sufficiently strong to counteract the gravitational effect on, and prevent the rebounding abrasive 20, gravel 27 and dust 37, respectively, from falling back into the blast heads 21, respectively. This is important, since the kinetic energy of the abrasive 20, gravel 27 and dust 37 upon rebound is not sufficient to carry this material upwardly along the entire length of the twin vertical abrasive conveyors 38 into the rotating screen drums 40. Indeed, the mobile road surface texturing apparatus 1 of this invention does not depend or rely upon rebound energy alone for this transportation and recycle of the abrasive 20, since the rebounding energy is sufficient strong to carry the abrasive 20, gravel 27 and dust 37 only to terminal velocity at approximately the height of the rebound neck 23, as illustrated in FIG. 1, where the air stream transports the abrasive 20, gravel 27 and dust 37 upwardly through the abrasive conveyors 38 and into the screen drums 40.

The following calculations illustrate that air flow velocity through the vertical abrasive conveyors 38 which is required to move the abrasive 20, gravel 27 and dust 37 from the point of rebound energy loss, or rebound area, to the abrasive separation system 7: As a particle falls by gravity through air, it accelerates until it reaches terminal velocity, or that velocity at which the particles' weight is matched by the aerodynamic drag impeding its fall. This velocity represents the maximum relative speed between a particle falling under operation of gravity and air and also defines the minimum air velocity required to convey a particle upwardly in a vertical duct against the pull of gravity. Neglecting other influences such as magnetic or electrostatic forces, the downward force acting on a particle is simple its weight.

Abrasive particles used for shot blasting are normally spherical in shape, with a rough surface. Of all the particles typically processed by the recovery mechanism of a shot blast unit, the spherical, all-steel shot is likely to be the most difficult to convey vertically, due to its high density and low surface area-to-weight ratio.

The weight of a sphere is defined by the equation:

$$W = w\pi d^3/6 \quad (1)$$

where:
W=weight of sphere (lb)
w=specific weight of the material (lb/ft$^3$); and
$\pi$=pi (3.1416)
d=diameter (ft)

Since particle diameter is usually expressed in inches, equation 1 is altered as follows:

$$W = w\pi(d/12)^3/6 = (3.03\times10^{-4})(wd^3) \quad (2)$$

where:
d is expressed in inches.

The aerodynamic drag on a body is expressed by the equation:

$$C = D_{Dq}A \quad (4)$$

where:
D=drag (lb)
$C_D$=drag coefficient (dimensionless)
q=dynamic pressure (lb/ft$^2$)
A=Cross-sectional area (ft$^2$)

$$q = \rho V^2/2g \quad (5)$$

where:
$\rho$=air density (0.0754 lb/ft$^3$)
V=air velocity (ft/sec.)
g=gravitational acceleration (32.2 ft/sec$^2$)

Using the known constants and calculating from 5, the following expression is derived:

$$q = (1.171\times10^{-3})(V^2) \quad (6)$$

The cross sectional area of a sphere is:

$$A = (\pi d^2/4)(1\ ft^2/144\ in^2) = (5.454\times10^{-3})(d^2) \quad (7)$$

Combining expressions 4, 6 & 7, the following expression is derived:

$$D = C_{Dq}A = C_D(1.17\times10^{-3})(V^2)(5.454\times10^{-3})(d^2,$$

or $$D = (6.387\times10^{-6})\ C_D V^2 d^2 \quad (8)$$

At the terminal velocity ($V_T$), drag=weight, so equating expressions 2 and 8 yields:

$$(3.03\times10^{-4})wd^3 = (6.387\times10^{-6})C_D V_T^2 d^2 \quad (9)$$

Collecting terms and simplifying:

$$V_T = 6.89\sqrt{wd/C_D} \quad 10)$$

where:
$V_T$=terminal velocity (ft/sec)
w=specific weight of the particle (lb/ft$^3$)
d=diameter of particle (inches)
$C_D$=drag coefficient (dimensionless)

The drag coefficient of a sphere is a function of the Reynolds Number, where the Reynolds Number is given by the expression:

$$R_N = Vd/12\gamma \quad (11)$$

where:
$R_N$=Reynolds Number (Dimensionless)
V=air velocity (ft/sec)
d=particle diameter (in)
$\gamma$=kinematic viscosity of air (0.0001567 ft$^2$/sec.)

Combining terms yields the expression:

$$R_N = 531.8\ Vd \quad (12)$$

In typical shot blast operations, conveying air velocities in the range of 50–150 feet per second can be achieved and spherical abrasive with diameters ranging from 0.040 inch to 0.100 inch are used. Therefore, a Reynolds Number in range of:

$1000 < R_N < 8000$ is appropriate.

In the range $R_N$ from 1000 to 8000, the drag coefficient can be described with reasonable accuracy by the equation:

$$C_D = 0.523 - 9.13\times10^{-6}R_N \quad (13)$$

To solve for an approximate value of terminal velocity, an average value of $C_D$=0.5 can be used. Thus, for an abrasive sphere made of steel having a specific weight of 500 lb/ft$^3$ and a diameter of 1/16 inch, the terminal velocity will be:

$$V_T = 6.89\sqrt{Wd/C_D} = 6.89\sqrt{(500)(1/16)/0.5} = 6.89\sqrt{62.5} = 54.5 \text{ ft/sec.}$$

A more precise answer can be obtained by taking this initial value for $V_T$, plugging it into equation 12 to obtain $R_N$, using that $R_N$ in equation 13 to calculate a new value for $C_D$ and then using the new $C_D$ in equation 10 to calculate a new terminal velocity ($V_T$). It may be necessary to iterate in this manner several times until the value of $C_D$ converges to a fixed value.

It will be further appreciated by those skilled in the art that the mobile road surface texturizing apparatus of this invention is designed to texture road surfaces and other horizontal structure surfaces to a desired extent, utilizing a spherical steel abrasive to produce a six foot wide swath in a single operation. The device operates to clean and texture a road or other horizontal surface without danger of subsurface fracture and the textured depth can be controlled on asphalt, concrete and polymer pavement. It also operates free of dry dust and requires no clean-up. Furthermore, a very high percentage of abrasive is recycled from impingement on the road surface, with very little abrasive loss and accompanying downtime. This minimal abrasive residue is apparent because the mobile road surface texturing apparatus moves in the direction of the arrows, as illustrated in FIGS. 1, 3 and 4 and the sweeping of the air flowing through the sweeper channel 10 and the corresponding blast heads 21 collects residual abrasive 20 which is expelled from the opposite set of abrasive propulsion devices 28 and may fail to rebound to the rebound neck 23 through the rebound legs 22 which are not swept by the air stream.

Furthermore, while a dual pair of oppositely-disposed abrasive propulsion devices 28 is illustrated in the mobile road surface texturing apparatus 1, along with twin vertical abrasive conveyors 38 and dual screen drums 40, more or less than two such sets of abrasive propulsion devices 28 and more or less than two vertical abrasive conveyors 38 and screen drums 40 may be incorporated, according to the teachings of this invention. Moreover, it is understood that the sweeper channel 10 may be located at any point in the air sweeper assembly 8 in order to effect the desired sweeping of air across the interior of the blast heads 21, as desired.

Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A mobile surface abrading apparatus comprising:

(a) a vehicle for movement over a surface to be treated;

(b) a reservoir carried by said vehicle for containing abrasive particles and at least one abrasive inlet connected to said reservoir;

(c) at least one pair of oppositely-disposed abrasive propulsion means connected to said abrasive inlet for receiving abrasive particles from said reservoir and directing the abrasive particles at high velocity against the surface at a contact and rebound area;

(d) at least one blast head carried by said vehicle and receiving said abrasive propulsion means, at least one air inlet provided in said blast head for receiving a stream of air at sufficient energy to overcome the terminal velocities of substantially all of the abrasive particles, dust and particulate debris and at least one outlet provided in said blast head, whereby said stream of air sweeps through said blast head from said inlet through said outlet in contact with the abrasive particles, dust and particulate debris;

(e) at least one vertical abrasive conveyor provided in said blast head between said abrasive propulsion means in communication with said outlet for receiving the stream of air, the abrasive particles and dust and particulate debris broken from the surface by impingement of the abrasive particles on the surface at said contact and rebound area, wherein the abrasive particles, dust and particulate debris are entrained in said stream of air travelling with said sufficient energy to overcome the terminal velocities of substantially all of the abrasive particles, dust and particulate debris, for conveying the abrasive particles dust and particulate debris upwardly in the stream of air; and (f) separator means connected to said conveyor means for separating the abrasive particles from the dust and particulate debris and returning the abrasive particles to said reservoir.

2. The mobile surface abrading apparatus of claim 1 wherein said separator means further comprises at least one drum having a center longitudinal axis and journalled for rotation along said center longitudinal axis, a fine screen defining the outside cylindrical surface of said drum and a coarse screen defining an inside cylindrical surface of said drum in spaced, concentric relationship with respect to said fine screen for collecting and separating the abrasive particles, dust and particulate debris.

3. The mobile surface abrading apparatus of claim 2 further comprising first screw conveyor means disposed beneath said drum for receiving dust and particulate debris from said drum and delivering the dust and particulate debris to a point of disposal and second screw conveying means disposed beneath said drum for receiving abrasive particles expelled from between said fine screen and said coarse screen and delivering the abrasive particles to said reservoir.

4. The mobile surface abrading apparatus of claim 1 wherein:

(a) said separator means further comprises at least one drum having a center longitudinal axis and journalled for rotation along the center longitudinal axis thereof, a fine screen defining the outside cylindrical surface of said drum and a coarse screen defining an inside cylindrical surface of said drum in spaced, concentric relationship with respect to said fine screen for collecting and separating the abrasive particles from the air, dust and particulate debris; and (b) said conveyor means further comprises at least one vertical abrasive conveyor projecting upwardly to said drum for transferring said abrasive particles, dust and particulate debris to said drum.

5. The mobile surface abrading apparatus of claim 4 further comprising first screw conveyor means disposed beneath said drum for receiving dust and particulate debris from said separator means and delivering the dust and particulate debris to a point of disposal and second screw conveying means disposed beneath said separator means for receiving abrasive particles expelled from between said fine screen and said coarse screen and delivering the abrasive particles to said reservoir.

6. The mobile surface abrading apparatus of claim 1 further comprising sweeper seal means carried by said blast head and communicating with the interior of said blast head and said contact and rebound area for containing rebounding abrasive particles and particulate debris.

7. The mobile surface abrading apparatus of claim 5 further comprising sweeper seal means carried by said blast head and communicating with the interior of said blast head and said contact and rebound area for containing rebounding abrasive particles and particulate debris.

8. The mobile surface abrading apparatus of claim 6 further comprising first screw conveyor means disposed beneath said separator means for receiving dust and particulate debris from said separate means and delivering the dust and particulate debris to a point of disposal and second screw conveying means disposed beneath said separator means for receiving abrasive particles expelled from said separator means and delivering the abrasive particles to said reservoir.

9. The mobile surface abrading apparatus of claim 6 further comprising a labyrinth sweeper channel provided in said blast head and communicating with said air inlet for receiving the stream of air.

10. The mobile surface abrading apparatus of claim 9 wherein:

(a) said separator means further comprises at least one drum having a center longitudinal axis and journalled for rotation along said center longitudinal axis, a fine screen defining the outside cylindrical surface of said drum and a coarse screen defining an inside cylindrical surface of said drum in spaced, concentric relationship with respect to said fine screen for collecting and separating the abrasive particles, dust and particulate debris; and (b) said conveyor means further comprises a single vertical abrasive conveyor projecting upwardly to said drum for transferring said abrasive particles, dust and particulate debris to said drum.

11. The mobile surface abrading apparatus of claim 10 further comprising first screw conveyor means disposed beneath said drum for receiving dust and particulate debris from said drum and delivering the dust and particulate debris to a point of disposal and second screw conveying means disposed beneath said drum for receiving abrasive particles expelled from between said fine screen and said coarse screen and delivering the abrasive particles to said reservoir.

12. A mobile surface abrading apparatus comprising:

(a) a highly maneuverable vehicle having tires for traversing a substantially horizontal surface to be treated;

(b) a reservoir carried by said vehicle for containing a supply of abrasive particles;

(c) at least one pair of blast heads shaped for receiving a stream of air, said blast heads having a reduced cross-section proportional to the velocity of said stream of air for effecting at least terminal velocity of the abrasive particles and the dust and particulate debris and at least one pair of oppositely-disposed abrasive propulsion means mounted in each of said blast heads in opposed relationship and connected to said reservoir, said abrasive propulsion means disposed in angular relationship with respect to the surface, for continuously directing abrasive particles from said reservoir at high velocity against the surface in a contact and rebound area as said vehicle travels; and (d) a pair of drums having a separate longitudinal axis and journalled for rotation with respect to the vehicle along said center longitudinal axis, a fine screen defining the outside cylindrical surface of each of said drums, a coarse screen defining an inside cylindrical surface of each of said drums in spaced, concentric relationship with respect to said fine screen, screen broom means provided in close proximity to each of said drums for contacting and cleaning said fine screen, at least one horizontally-oriented, downwardly-inclined tray positioned substantially in alignment with the top of said blast heads to receive the abrasive particles and particulate debris for collecting the abrasive particles and particulate debris, absorbing the energy of the abrasive particles and particulate debris and preventing excessive rebounding of the abrasive particles and particulate debris.

13. The mobile surface abrading apparatus of claim 12 further comprising a pair of first screw conveyors disposed beneath said drums, respectively, for receiving dust and particulate debris from said drums and delivering the dust and particulate debris to a point of disposal and a second screw conveyor disposed beneath said drums for receiving abrasive particles expelled from between said fine screen and said coarse screen and delivering the abrasive particles to said reservoir.

14. The mobile surface abrading apparatus of claim 12 further comprising sweeper seal means carried by said blast head and communicating with the interior of said blast head and said contact and rebound area for containing rebounding abrasive particles and particulate debris.

15. The mobile surface abrading apparatus of claim 13 further comprising:

(a) a labyrinth sweeper channel provided in said blast heads and communicating with said air inlet for receiving the stream of air; and (b) sweeper seal means carried by said blast head and communicating with the interior of said blast head and said contact and rebound area for containing rebounding abrasive particles and particulate debris.

16. A mobile surface abrading apparatus comprising:

(a) a highly maneuverable vehicle having tires for traversing a substantially flat surface to be treated;

(b) a reservoir carried by said vehicle for containing a supply of abrasive particles;

(c) a pair of blast heads shaped for receiving a stream of air and directing said stream of air upwardly, said blast heads each having a reduced cross-section proportional to the velocity of said stream of air for effecting greater than terminal velocity of the abrasive particles and dust and the particulate debris at said reduced cross-section and a separate pair of oppositely-disposed abrasive propulsion devices mounted in each of said blast heads and connected to said reservoir, said abrasive propulsion devices disposed in angular relationship with respect to the surface for continuously directing abrasive particles from said reservoir at high velocity against the surface in a contact and rebound area as said vehicle travels;

(d) drive means connected to said abrasive propulsion devices for driving said abrasive propulsion devices at high speed; and (e) a pair of drums journalled for rotation with respect to the vehicle along the center longitudinal axis of said drums, a fine screen defining the outside cylindrical surface of each of said drums, a coarse screen defining an inside cylindrical surface of each of said drums in spaced, concentric relationship with respect to said fine screen, screen broom means provided in close proximity to each of said drums for contacting and cleaning said fine screen, at least one horizontally-oriented, downwardly-inclined tray positioned substantially in alignment with the top of said blast head to receive the abrasive particles and particulate debris for collecting the abrasive particles and particulate debris, absorbing the kinetic energy of the abrasive particles and particulate debris and preventing excessive rebounding of the abrasive particles and particulate debris.

17. The mobile surface abrading apparatus of claim 16 further comprising a pair of first screw conveyors disposed beneath said drums, respectively, for receiving dust and particulate debris from said drums and delivering the dust and particulate debris to a point of disposal and a second screw conveyor disposed beneath said drums for receiving abrasive particles expelled from between said fine screen and said coarse screen and delivering the abrasive particles to said reservoir.

18. The mobile surface abrading apparatus of claim 17 further comprising:

(a) a labyrinth sweeper channel provided in said blast heads and communicating with said air inlet for receiving the stream of air; and (b) sweeper seal means carried by said blast heads and communicating with the interior of said blast heads and said contact and rebound area for containing rebounding abrasive particles and particulate debris.

* * * * *